US005353748A

United States Patent [19]

Kayahara et al.

[11] Patent Number: 5,353,748

[45] Date of Patent: Oct. 11, 1994

[54] COMBUSTION METHOD AND APPARATUS FOR REDUCING EMISSION CONCENTRATIONS OF $NO_x$ AND CO

[75] Inventors: Toshihiro Kayahara; Osamu Tanaka; Akinori Kawakami; Tetsushi Nakai; Kazuhiro Ikeda, all of Matsuyama, Japan

[73] Assignee: Miura Co., Ltd., Ehime, Japan

[21] Appl. No.: 107,597

[22] Filed: Aug. 18, 1993

[30] Foreign Application Priority Data

Sep. 9, 1992 [JP] Japan ..... 4-268055

[51] Int. Cl.[5] ..... F22B 5/02

[52] U.S. Cl. ..... 122/18; 122/14; 122/367.3

[58] Field of Search ..... 122/18, 14, 138, 153, 122/448.3, 494

[56] References Cited

U.S. PATENT DOCUMENTS 4,413,590 11/1983 Landreau ..... 122/18
4,499,859 2/1985 Nishiguchi et al. ..... 122/18
5,020,479 6/1991 Suesada et al. .
5,199,384 4/1993 Kayahara et al. ..... 122/18

FOREIGN PATENT DOCUMENTS 60-78247 5/1985 Japan .

*Primary Examiner*—Edward G. Favors

[57] ABSTRACT

A combustion flame is distributed so as to cross a group of heat absorbing tubes arranged parallel to and spaced from one another, thereby cooling the combustion flame. A specific temperature zone of approximately 1000° C.-1300° C. for suppressing generation of $NO_x$ and accelerating oxidation of CO is locally formed within the heat absorbing tubes by decimating at least one tube. In the zone, CO generated upstream of the zone is oxidized by reacting with reaction radicals generated by combustion and/or oxygen.

17 Claims, 15 Drawing Sheets

【図3】

COMBUSTION METHOD AND APPARATUS FOR REDUCING EMISSION CONCENTRATIONS OF $NO_x$ AND CO

BACKGROUND OF THE INVENTION

1. Field of the Invention

The present invention relates to a combustion method and apparatus for reducing emission concentrations of $NO_x$ (nitrogen oxides) and CO (carbon monoxide), which is suitable for use in water-tube boilers such as once-through boilers, natural circulation water-tube boilers, and forced circulation water-tube boilers.

2. Description of the Prior Art

In recent years, there has been a demand for further reducing emission concentrations of harmful combustion exhausts, particularly of $NO_x$ and CO, also in boilers from the environmental pollution's viewpoint and the like. There have already been proposed various types of measures for reducing the emission concentrations of such harmful combustion exhausts. As one of the measures for the reduction, there is known from U.S. Pat. No. 5,020,479 a technique that heat absorbing tubes are brought as close as possible to the burner combustion surface so that the group of heat absorbing tubes are positioned in the combustion flame, wherein heat exchange and flame cooling are simultaneously effected to thereby suppress generation of thermal $NO_x$ and moreover realize high-load combustion. It is noted that "combustion flame" herein used refers to high-temperature gas that is under progress of combustion reaction, the high-temperature gas including combustible premixed gas, which has not yet burned completely, and burnt gas, which has been generated as a result of combustion. Also, the term combustion flame can be replaced by combustion gas.

However, this conventional measure, although capable of reducing the emission concentration of $NO_x$, results in a slightly high emission concentration of CO which is a problem. One cause of this, it is suspected, is that the cooling of combustion flame to be rendered for $NO_x$ reduction in turn produces a rapid cooling effect upon CO, thereby freezing the reaction such that part of the combustion gas is discharged outside the system as unreacted substances, i.e. CO and others, remaining at its equilibrium concentration. To solve this problem, proposed in Japanese Patent Laid-Open Publication SHO 60-78247 was a technique in which after flame temperature is controlled to above 1000° C. and below 1500° C. by a cold substance placed in proximity to or in contact with a flame generated by high-load combustion, residual CO in the flame is oxidized in an adiabatic space provided downstream of the cold object, thus being transformed into $CO_2$ (carbon dioxide).

However, this technique is intended to reduce the emission of CO, and not to suppress the generation of $NO_x$. For this reason, the adiabatic space temperature of $NO_x$ may increase depending on where the adiabatic space is located, such that $NO_x$ will be generated. Also, there is another problem that temperature rise of the boiler body wall that defines the adiabatic space may become large, depending on the conditions under which the adiabatic space is formed. To prevent this temperature rise, it is necessary to provide a thermal insulant on the inner surface of the boiler body wall of the adiabatic space side, which leads to an increase in system cost. Further, when the thermal insulant is provided, there may arise a possibility that the thermal insulant may drop over long-term use. Furthermore, with a high flow velocity of the combustion flame, necessary transformation of CO to $CO_2$ can be accomplished by ensuring an elongated length of the adiabatic space in the direction of combustion flame flow, whereas in this case the thermal efficiency is reduced, such that the boiler body cannot be reduced in size, unfavorably.

SUMMARY OF THE INVENTION

Accordingly, an essential object of the present invention is to provide a combustion method and apparatus which can suppress the generation of $NO_x$, reduce CO generated, and prevent lowering of thermal efficiency. Another object of the present invention is to provide a boiler which is capable of suppressing the generation of $NO_x$, reducing CO generated, and preventing lowering of thermal efficiency, and which is thus less in emission amount of harmful substances, small in size, and high in efficiency.

The present invention, having been achieved with a view to solving the foregoing problems provides a combustion method characterized in that a combustion flame flows so as to cross a group of heat absorbing tubes provided substantially parallel to one another and at specified intervals, so that the combustion flame is cooled by the group of heat absorbing tubes, and spaces of specific temperature zone for suppressing generation of $NO_x$ and accelerating oxidation of CO are locally formed in the group of heat absorbing tubes, in which space CO generated upstream thereof is oxidized by reacting with reaction radicals generated by combustion and/or oxygen. Also, the present invention provides a combustion method as claimed in claim 1, wherein temperature range of the specific temperature zone is approximately 1000° C.–1300° C.

The present invention provides a combustion apparatus which comprises: a pair of heat absorbing tube wall means disposed at a spacing and substantially in parallel to each other; burner means disposed on one side of a section defined by the heat absorbing tube wall means; combustion exhaust gas outlet means provided on the other side of the section; a group of heat absorbing tubes composed of a large number of heat absorbing tubes provided substantially parallel to one another and at specified intervals so that the heat absorbing tubes cross a combustion flame from the burner means; and a combustion device having a space of specific temperature zone locally formed for suppressing generation of $NO_x$ and accelerating oxidation of CO in the group of heat absorbing tubes.

The present invention provides a combustion apparatus wherein temperature range of the specific temperature zone is approximately 1000° C.–1300° C.

The present invention provides a combustion apparatus wherein the burner means is a premixed burner.

The present invention provides a combustion apparatus wherein the heat absorbing tubes located around the space of specific temperature zone include heat absorbing tubes constituting the heat absorbing tube wall means and heat absorbing tubes located between a pair of heat absorbing tube wall means.

The present invention provides a combustion apparatus wherein the heat absorbing tube wall means comprises a plurality of heat absorbing tubes disposed substantially in parallel to and spaced from one another along the direction of flow of combustion flame, and finned members for connecting adjacent heat absorbing tubes to one another.

The present invention provides a combustion apparatus wherein the heat absorbing tubes constituting the heat absorbing tube wall means and the heat absorbing tubes located between the heat absorbing tube wall means are arranged in a specified arrangement pattern with gaps between adjacent heat absorbing tubes smaller than the outer diameter of the heat absorbing tubes, and the space of specific temperature zone is formed by decimating the heat absorbing tubes located between the heat absorbing tube wall means.

The present invention provides a combustion apparatus wherein a plurality of columns of meandered flame flow passages are formed between heat absorbing tubes of the group of heat absorbing tubes located upstream of the space of specific temperature zone, downstream-side end portions of the flame flow passages communicating with the space of specific temperature zone.

Further, the present invention provides a combustion apparatus wherein the group of heat absorbing tubes is a group of water tubes of a water-tube boiler.

According to the present invention the combustion flame in the space of specific temperature zone is sufficient to transform residual CO into $CO_2$ by oxidation reaction, and is at such low temperatures as will result in less generation of thermal $NO_x$, so that contact between unreacted CO and oxygen of reaction radicals and/or oxygen atoms (O) or the like is actively effected, whereby the residual CO is transformed into $CO_2$ by oxidation reaction, reducing generation of CO and suppressing generation of $NO_x$.

According to the present invention since the space of specific temperature zone is locally formed, there is provided a combustion apparatus which is free from the need of a great scale of boiler body, does not suffer from a decrease in its high efficiency and thus which is less in emission amounts of $NO_x$ and CO, small in size, and high in efficiency.

According to the present invention since the combustion flame temperature of the space of specific temperature zone is above approximately 1000° C., there is produced a great effect of CO reduction. Also, since the combustion flame temperature of the space of specific temperature zone is below approximately 1300° C., there is produced a great effect of suppressing $NO_x$ generation. Further, according to the present invention use of a premixed burner means leads to less amounts of generation of $NO_x$, compared with diffusion combustion burners, and thus a combustion apparatus can be provided which involves less amount of generation of $NO_x$.

According to the present invention since the space of specific temperature zone is locally formed, having heat absorbing tubes arranged therearound, a combustion flame in the space of specific temperature zone is kept within a temperature range of the specific temperature zone without being rapidly cooled, thus suppressing generation of $NO_x$ and reducing CO amount.

According to the present invention combustion flames flowing through different meandered flame flow passages are subjected to mixing in the space of specific temperature zone, accelerating contact between unreacted CO and reaction active radicals and/or oxygen. Thus, in spite of a rather narrow space, a great reduction in CO amount can be attained.

Further, according to the present invention there is provided a water tube boiler which is less in emission amounts of $NO_x$ and CO and high inefficiency.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE PREFERRED EMBODIMENTS

FIGS. 1 to 4 illustrate an embodiment of the invention in which a combustion method and apparatus according to the present invention is applied to a multi-tube once-through boiler, which is a kind of water tube boiler.

Figure 1:
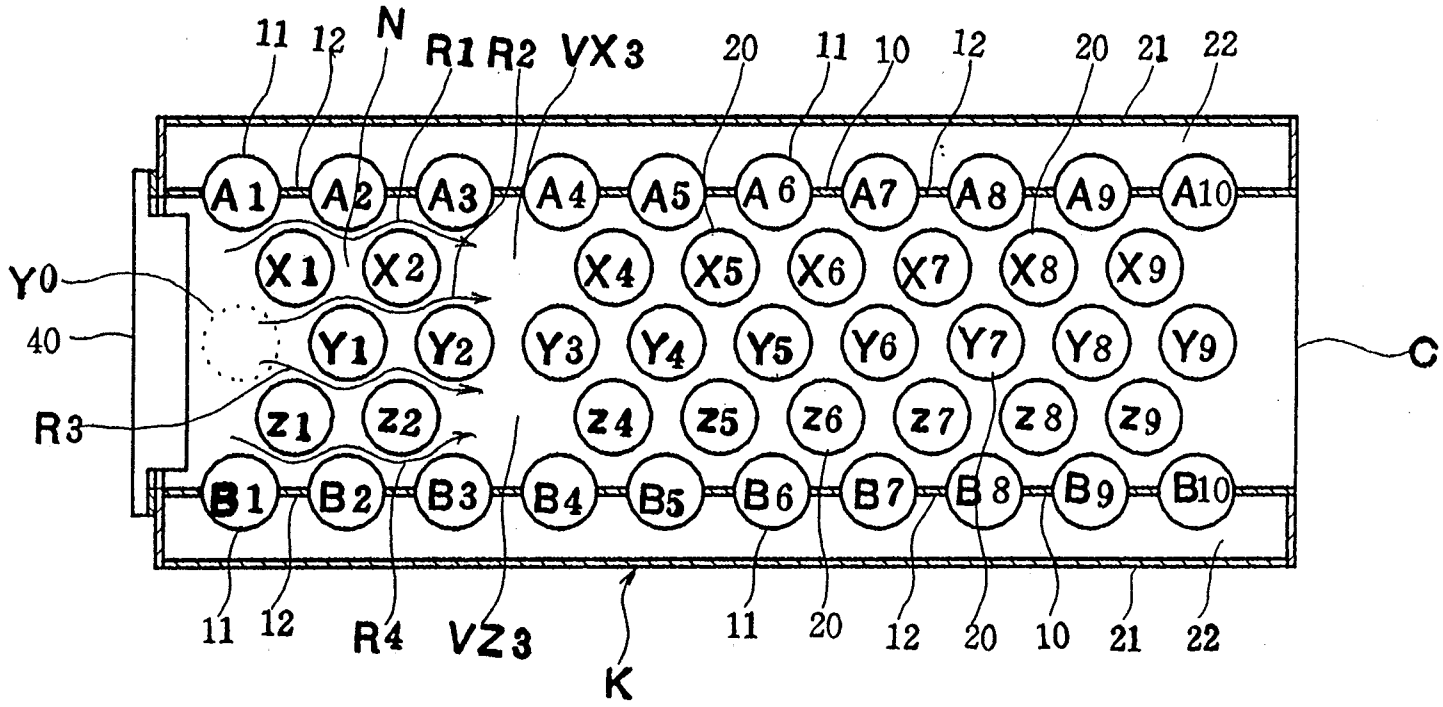
FIG. 1 is a plan view, partly in section, schematically illustrating the structure of a boiler body according to an embodiment of the present invention.

Referring to FIG. 1, a rectangular boiler body K of the multi-tube once-through boiler comprises: vertical heat absorbing tube walls (hereinafter, referred to simply as tube walls) 10, 10 arranged along the direction of flow of combustion flames injected from later-described burner means (i.e. in the longitudinal direction of boiler body); a large number of vertical heat absorbing tubes 20, 20, . . . (constituting a group of heat absorbing tubes) which are substantially parallel to and spaced from one another and which are so arranged between the tube walls 10, 10 as to cross a combustion flame; burner means 40 disposed at an opening on one side between the tube walls 10, 10; a combustion exhaust gas outlet C formed at an opening on the other side between the tube walls 10, 10; and the like. The tube walls 10, 10 define a combustion and/or heat exchange section N. The aforementioned combustion exhaust gas outlet C may properly be provided at an end portion of the combustion and/or heat exchange section N on one side opposite to the burner; for example, it can be provided by opening and removing a part of a tube wall 10.

The tube walls 10, 10, in this embodiment, are arranged to be juxtaposed each with a plurality of heat absorbing tubes 11 arrayed at appropriate intervals in the direction of flow of the combustion flame. The gaps of the heat absorbing tubes 11, 11, . . . being closed by plate-shaped finned members 12, 12, . . . extending axially of these heat absorbing tubes 11, i.e. the finned members 12, 12, . . . connect adjacent heat absorbing tubes to each other. These tube walls 10, 10 are disposed substantially parallel to and appropriately spaced from each other. Cover members 21, 21 are attached outside the tube walls 10, 10 and adiabatic spaces 22, 22 are formed between the tube walls 10, 10.

The heat absorbing tubes 20, 20, . . . include three heat absorbing tube columns X, Y, Z to be arranged in the direction of flow of combustion flame. Hereinafter, the heat absorbing tubes 20, 20, . . . are designated by adding 1, 2, 3, . . . to the column denotations X, Y, and Z in such an order that the tubes are apart from the burner means 40 farther and farther; as X1, X2, . . . Y1, Y2, . . . , Z1, Z2, . . . ; and the heat absorbing tubes 11, 11, . . . constituting the tube walls 10, 10 are designated by tube numbers A1, A2, . . . , B1, B2, . . . as classified according to the columns.

Figure 2:
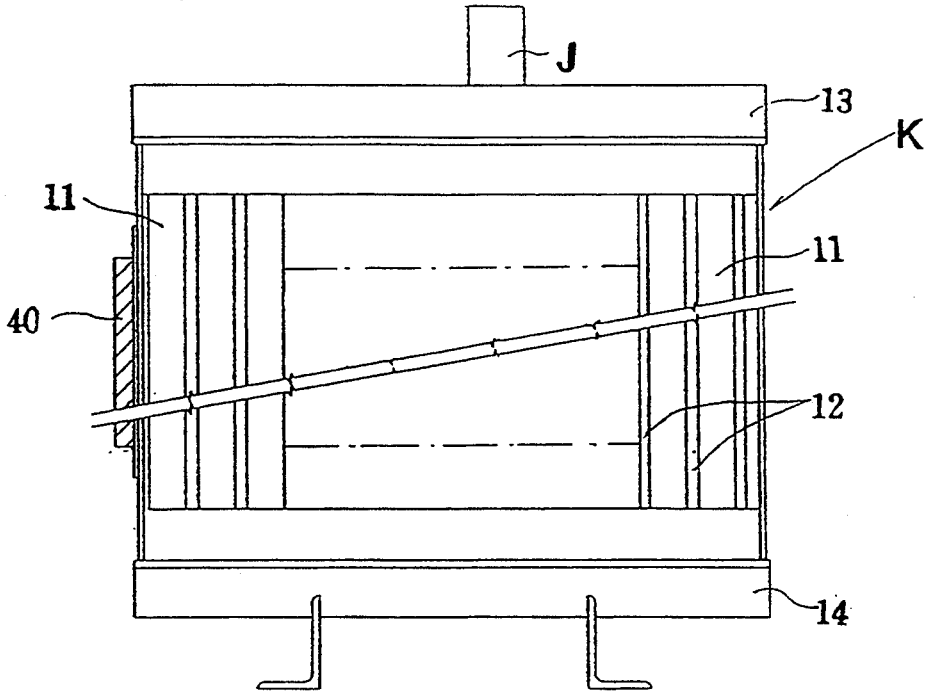
FIG. 2 is a side view of the boiler body in a state in which the boiler body cover is removed in the same embodiment.
Figure 3:
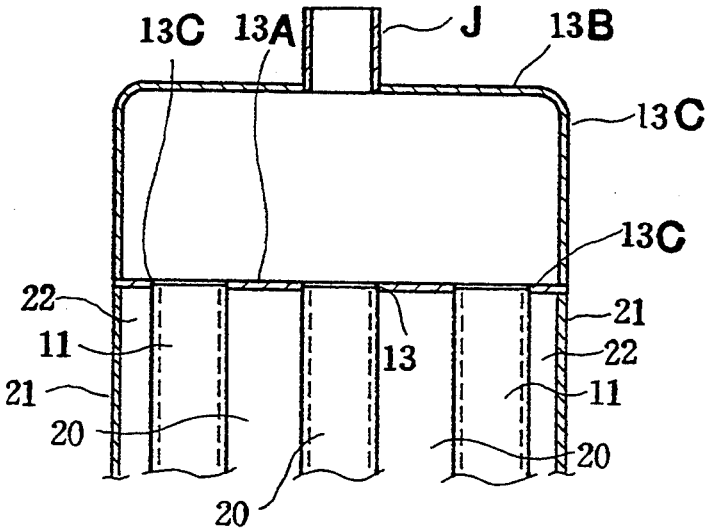
FIG. 3 is a partly sectional side view of the boiler body of the same embodiment.

Referring to FIGS. 2 and 3, upper ends and lower ends of the heat absorbing tubes 20, 20, . . . disposed between the heat absorbing tubes 11, 11, . . . constituting the tube walls 10, 10 and between the tube walls 10, 10 are communicatably connected to an upper header 13 and a lower header 14, respectively. It is to be noted that header can also be referred to as chamber. Both headers are joined airtight with the upper and lower ends of the tube walls 10, 10, defining the section N in four directions of upward and downward, rightward and leftward in cooperation with the tube walls 10, 10 so that combustion flames and burnt gases will not leak outside the boiler body. Of the remaining two openings, one is provided with burner means 40, and the other connected with an economizer (feed water preheater) E; the opening may be connected directly to an exhaust duct H (see FIG. 4). It is noted that the upper header 13 and the lower header 14 are fundamentally of the same and known construction, thus only the upper header 13 being described below. The upper header 13 comprises a tube plate 13A having openings 13C for connecting upper ends of the heat absorbing tubes 11, 11, . . . and the heat absorbing tubes 20, 20, and a drum plate 13B connected airtight to the tube plate 13A and having a steam outlet tube J attached thereto. In the steam boiler, while the system is under normal operation, the entire lower header 14 and lower part of the heat absorbing tubes 11, 11, . . . and the heat absorbing tubes 20, 20, . . . are normally filled with water, and upper part of the heat absorbing tubes 11, 11, . . . and the heat absorbing tubes 20, 20, . . . and the upper header 13 are filled with steam.

The plurality of heat absorbing tubes 20, 20, . . . disposed between the tube walls 10, 10 are so arranged, as described before, that three columns X, Y, and Z are disposed in the direction of flow of combustion flame, where heat absorbing tubes of adjacent columns including the heat absorbing tubes 11, 11, . . . of the tube walls 10, 10 are staggered with each other. Also, the gaps between the heat absorbing tubes 11, 11, . . . and the gaps the heat absorbing tubes 20, 20, . . . and the gaps between the heat absorbing tubes 11, 11, . .. and absorbing tubes 20, 20, . . . which form the distribution passages for combustion flame are preferably set equal to or less than the outer diameter of the heat absorbing tubes 11 and 20, where these gaps may be either all identical or different and are required only to be within the aforementioned conditions.

Figure 4:
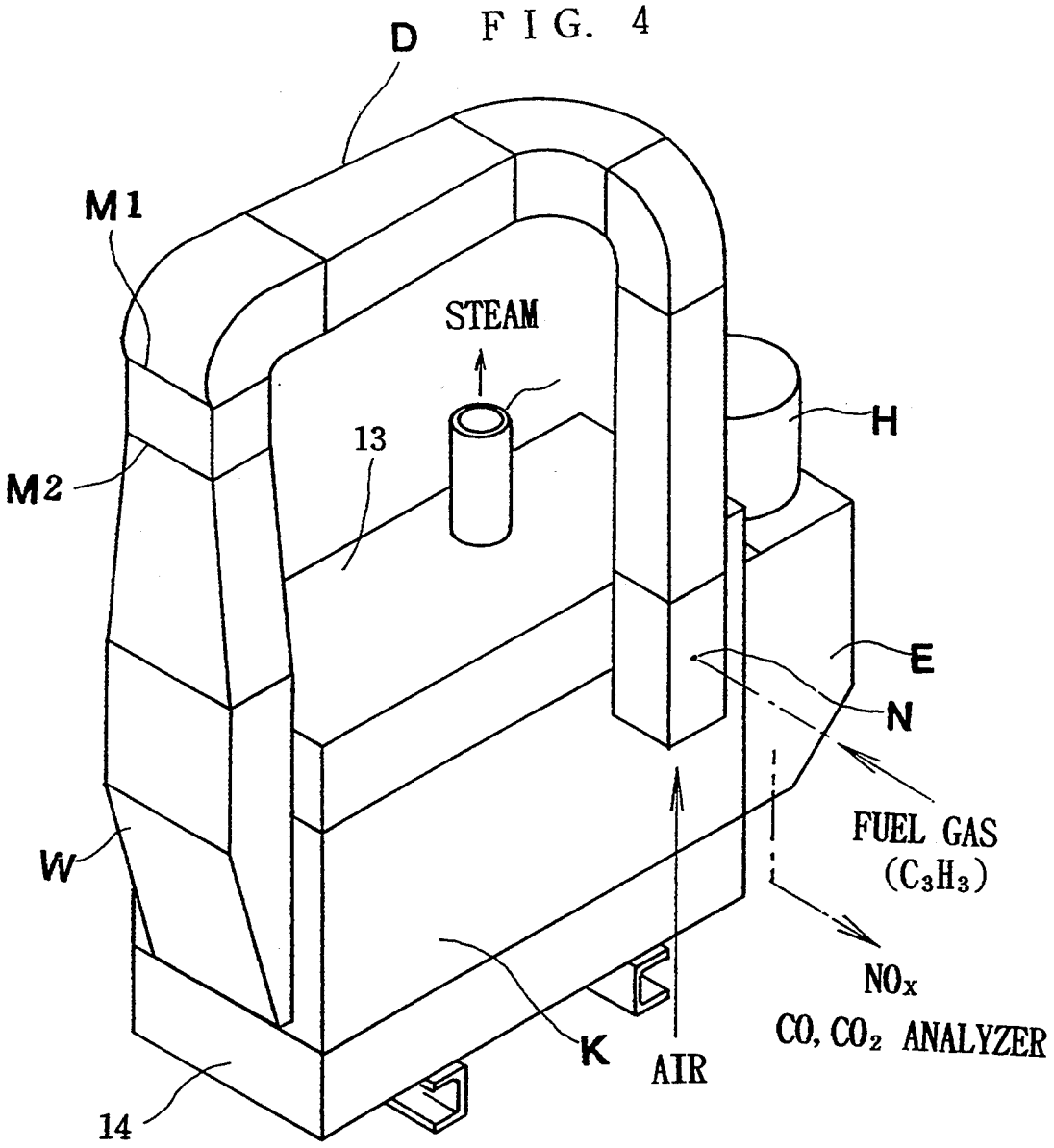
FIG. 4 is an appearance perspective view of the overall apparatus according to an embodiment of the present invention.

Out of the aforementioned heat absorbing tubes 20, 20, . . . , a specific temperature zone is previously determined from experiments. The expression "a specific temperature zone" used herein is employed to mean "the zone for the temperature range suitable for suppressing generation of $NO_x$ and reducing generated CO by oxidation". In this embodiment, the boiler body having spaces VX3, VZ3 of specific temperature zone in FIG. 1 is set at this location. In other words, in this embodiment, a specific temperature zone in which the combustion flame temperature is approximately 1000° C.–1300 ° C. is determined from experiments with the boiler system as shown in FIG. 4 by using a boiler body K′ having heat absorbing tube arrays as shown in FIG. 12, and heat absorbing tubes X3 and Z3 that fall upon the specific temperature zone are decimated (tube-removed), thereby forming spaces VX3 and VZ3 of the specific temperature zone.

Figure 8:
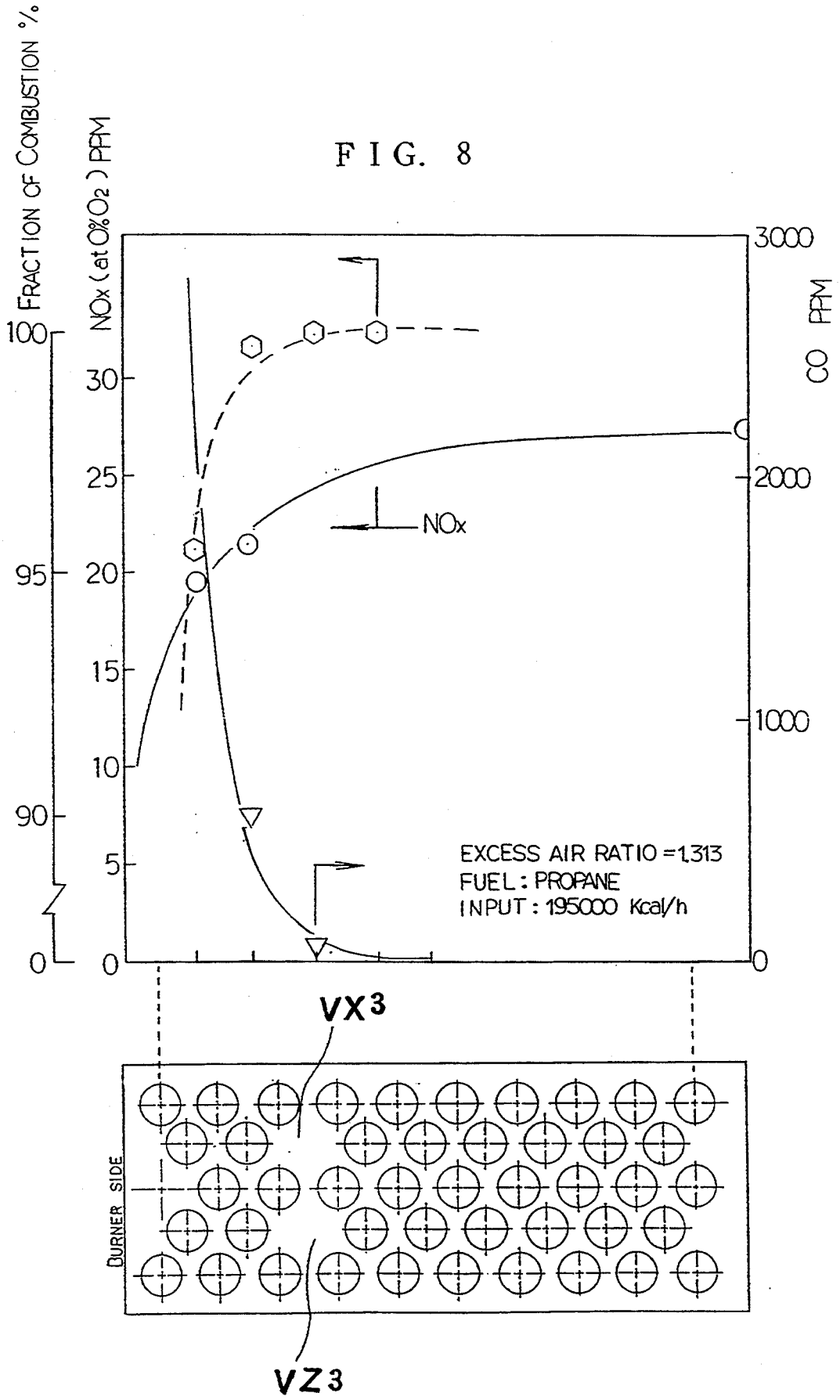
FIG. 8 is a chart of $NO_x$ generation, CO reduction, and reaction rate characteristics within the boiler body of the same embodiment.
Figure 12:
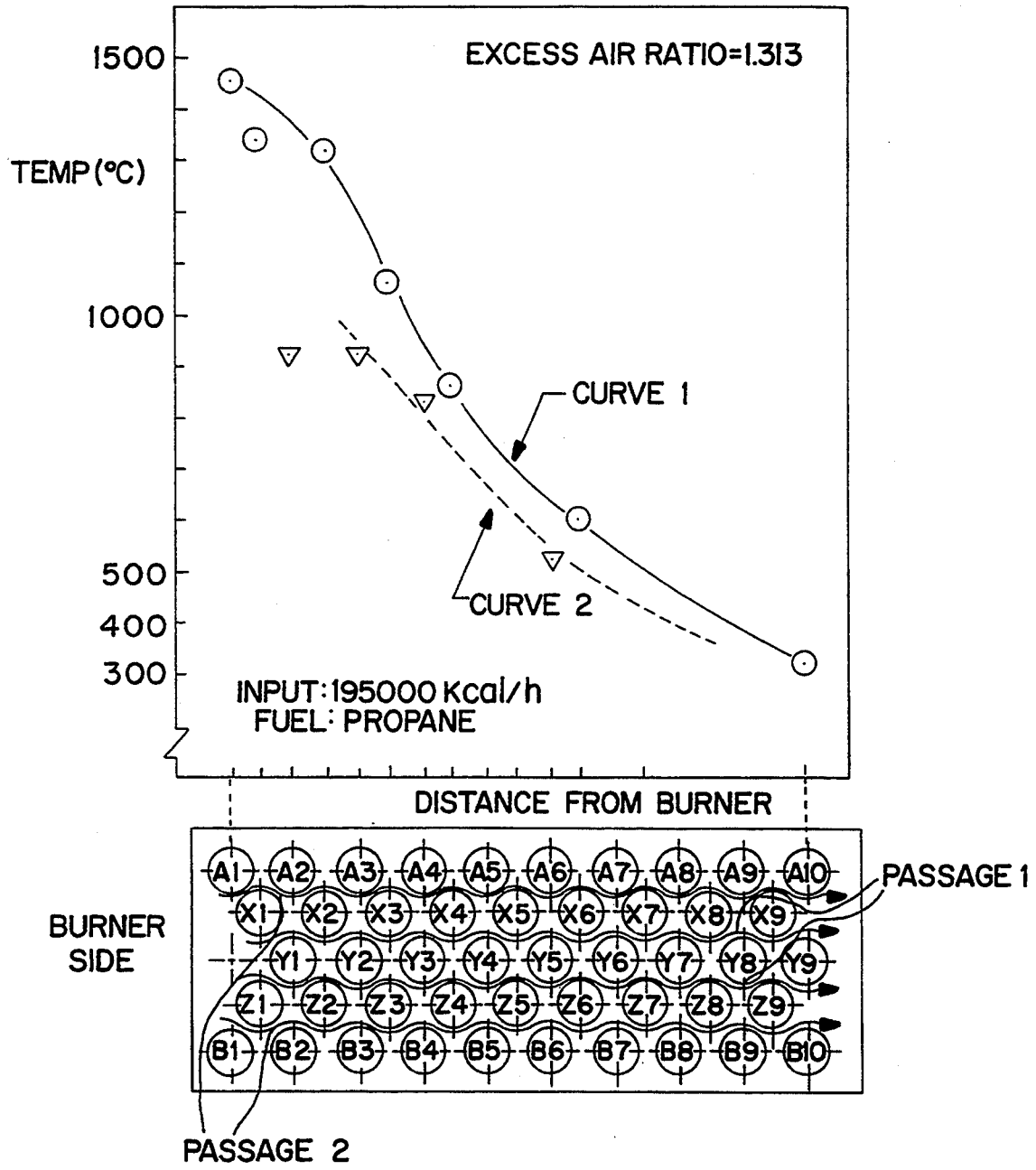
FIG. 12 PRIOR ART
FIG. 12 is a chart of combustion gas temperature characteristic within the prior-art boiler body.

In FIG. 12, it is noted, curve 1 is a temperature curve at a flow passage 1, and curve 2 is a temperature curve at a flow passage 2. The temperature of these spaces VX3 and VZ3 of specific temperature zone is equal to or slightly lower than that of the conventional boiler body of FIG. 12, with the result that the temperature of the spaces VX3 and VZ3 of specific temperature zone is maintained at approximately 1000° C.–1300° C. As shown in FIG. 8, at places where the spaces VX3 and VZ3 of specific temperature zone are located there are almost no combustible gases, meaning that the combustion reaction has been almost completed, whereas the temperature of the spaces VX3 and VZ3 of specific temperature zone depends on how balanced the heat generation is due to combustion of a small amount of combustible gases and oxidation reaction of CO and the heat absorption by the surrounding heat absorbing tubes.

Accordingly, if the spaces VX3 and VZ3 of specific temperature zone were formed where the combustion reaction is actively effected, there would be generated thermal $NO_x$ disadvantageously. Further, to effectively transform CO into $CO_2$, it is required to allow a residence time for combustion flames in the spaces of specific temperature zone in addition to the requirement that the combustion flame temperature is controlled to approximately 1000° C.–1300° C.

This residence time depends on the flow velocity of combustion flames and the flowing state of gases in the spaces of specific temperature zone. That is, when the flow velocity of combustion flames is large, it is necessary to prolong the length of the spaces of specific temperature zone in the direction of flow of combustion flames. As to the flowing state in the spaces of specific temperature zone, the gas residence time can be allowed by making the gas flow complex to generate eddy currents, while the reaction between CO and oxygen of reaction radicals (free radicals) such as OH and/or oxygen atoms (O) and the like is accelerated advantageously. From such a viewpoint, in this embodiment, tube-decimating position is determined to form the spaces of specific temperature zone. When decimating the heat absorbing tubes X3 and Z3, the tube holes provided in the tube plate of the headers 13, 14 are closed.

The spaces VX3 and VZ3 of specific temperature zone, rather narrow (the diameter of the zone: the sum of two times the gap between the heat absorbing tubes and the diameter of the heat absorbing tubes) as it is, serves as local residence spaces which allow residence of combustion flames. As a result, the residual CO generated in the high-temperature combustion flame zones upstream of the spaces VX3 and VZ3 of specific temperature zone is reacted and oxidized with oxygen of reaction radicals and/or oxygen atoms (O) and the like, thus reducing CO amount and suppressing generation of $NO_x$. The residence time of combustion flames in the spaces VX3 and VZ3 of specific temperature zone, according to calculation, is estimated as approx. 9.5 msec, assuming that the input is 8.66 $Nm^3/h$, the flow passage width is 0.0615 m, the flow passage sectional zone is 0.0246 $m^2$, and the combustion flame temperature is 1200° C.

In the embodiment of FIG. 1, around the spaces VX3 and VZ3 of specific temperature zone there are positioned heat absorbing tubes A3, A4, X4, Y3, Y2, and X2, and heat absorbing tubes Y2, Y3, Z4, B4, B3, and Z2, where heat exchange between these heat absorbing tubes and combustion flames in the spaces VX3 and VZ3 is carried out relatively slowly, so that the combustion flames are suppressed from generating $NO_x$ and residual CO is oxidized by reacting with oxygen of reaction active radicals and/or oxygen atoms (O). Thus, generation of $NO_x$ is suppressed and CO amount is reduced.

Moreover, at the same time, by making the zone of the spaces VX3 and VZ3 of specific temperature zone rather narrow (less in the number of decimated heat absorbing tubes in the direction of flow of combustion flames), the boiler body can be high in efficiency and small in size by being maintained successful in space-saving and thermal efficiency properties.

Upstream of the spaces VX3 and VZ3 of specific temperature zone, there are formed four meandered flame flow passages R1, R2, R3, and R4 made of gaps between heat absorbing tubes 11, 11, . . . 20, 20, . . . , which are formed between the heat absorbing tubes 11, 11, . . . and the heat absorbing tubes 20, 20, . . . and between one another of the heat absorbing tubes 20, 20, . . . , whereby the spaces VX3 and VZ3 of specific temperature zone are formed at junction portions of two flame flow passages R1 and R2, R3 and R4, respectively, as enlarged flame flow passages. As a result of this, in the spaces VX3 and VZ3 of specific temperature zone, combustion flames that have flowed over through the different flame flow passages are mixed together while combustion flames containing large amounts of CO in proximity to the surfaces of the heat absorbing tubes 11, 11, . . . and the heat absorbing tubes 20, 20, . . . join with combustion flames which do not contain large amounts of CO that have been distributed over portions farther from the surfaces of the heat absorbing tubes 11, 11, . . . and the heat absorbing tubes 20, 20, . . . , thus mixing together. By this mixing, contact between unreacted CO and oxygen of reaction active radicals and/or oxygen atoms and the like is actively accelerated while the high-temperature residence time of the combustion gases is prolonged enough to render efficient CO reduction.

Figure 5:
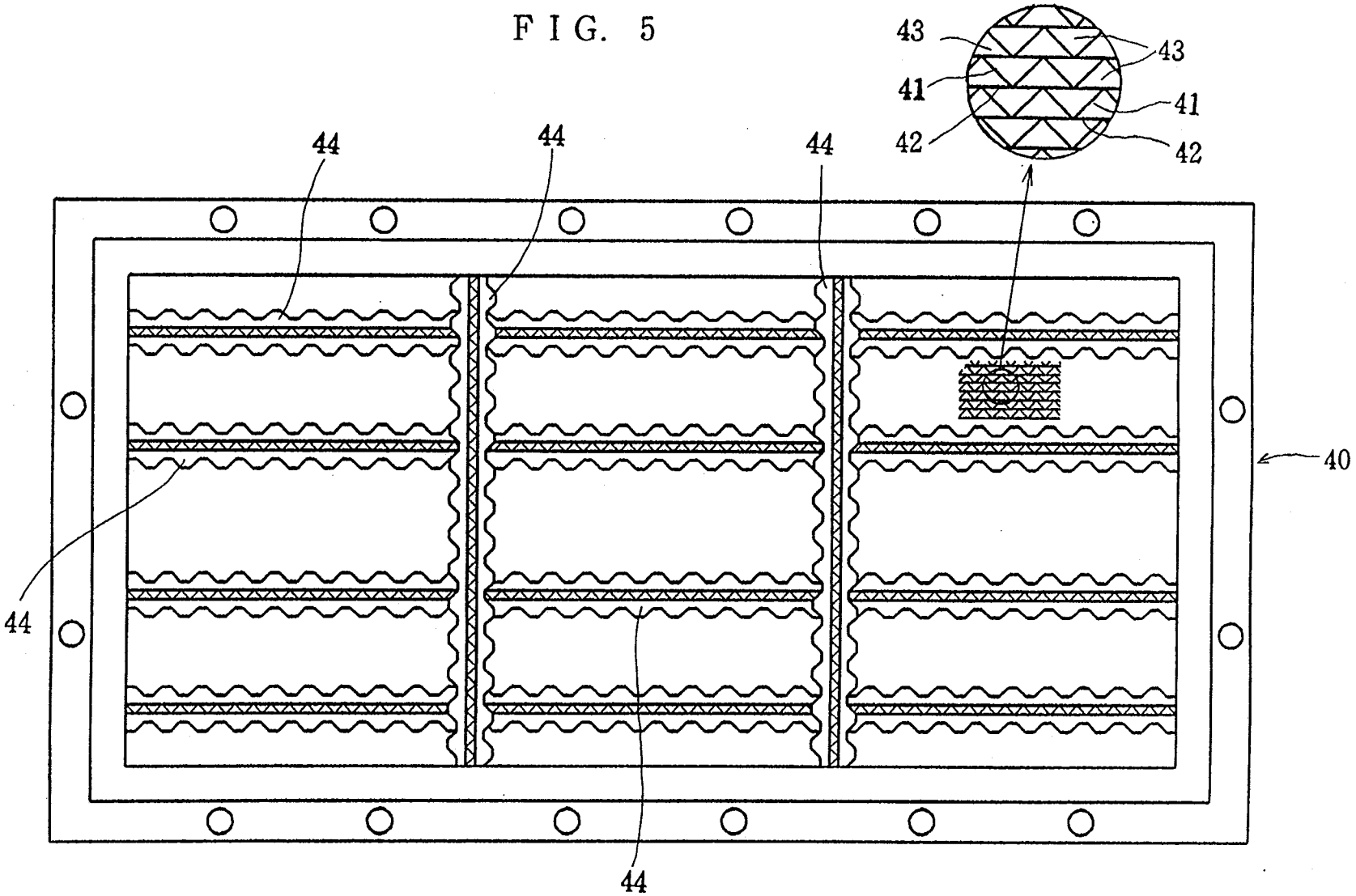
FIG. 5 is a front view and a partly enlarged frontview of the burner of the same embodiment.

The burner means 40 is preferably provided by use of a premixed flat burner. An example of this burner, as shown in FIGS. 5 is composed of corrugated thin metal tapes 41 and a flat thin metal tape 42, alternately laminated to form a honeycomb structure for many small passages 43 of gas-air mixture. On the burner surface, a few lines of flow restrictors or flame dividers 44 are attached to hold flames. In addition, the burner means 40 may also be provided by use of a ceramic plate burner having numerous small holes for injecting premixed gas, or by use of other various types of burners such as vapor combustion oil burners. The gap of the burner means 40 to the preceding heat absorbing tube 20 (facing the burner means 40) is set to a specified length, for example approximately equal to or smaller than three times the outer diameter of the heat absorbing tube 20. Also, the heat absorbing tube closest to the burner means 40 out of the heat absorbing tubes 11, 11, . . . of the tube walls 10, 10 is set by referencing the aforementioned length.

With the above arrangement, a combustion flame from the burner means 40, continuing to be burning in the gap spaces between the heat absorbing tubes 11, 11, . . . 20, 20, . . . , pass through the four combustion flame flow passages R1, R2, R3, and R4, distributed toward the exhaust gas outlet C, while heat transfer (heat exchange) to the heat absorbing tubes 11, 11, . . . 20, 20, . . . is effected. When this is done, since the gaps between the burner means 40, the preceding heat absorbing tube 20, and the heat absorbing tubes 11, 11, . . . 20, 20, . . . are set narrow as described above, the combustion flames are distributed toward the combustion exhaust gas outlet C while keeping at high flow velocities, thus cool ed with extremely high contact heat transfer rate.

The combustion flames that have passed through the flame flow passages R1, R2, R3, and R4 join together in the spaces VX3 and VZ3 of specific temperature zone. At these places, the temperature of the combustion flame is maintained at approximately 1000° C.–1300 ° C., suppressing generation of $NO_x$, while CO generated in the upstream high-temperature combustion flame zones reacts with oxygen of reaction active radical and/or oxygen atoms and the like, thus oxidized, by a high-temperature residence effect of combustion flames, reducing CO amount.

Also, since heat absorbing tubes are arranged around the spaces VX3 and VZ3 of specific temperature zone, i.e. heat transfer surfaces (heat absorbing tubes) are present at positions of specified lengths, temperature variation is restricted to approximately 50° C. thus suppressing generation of $NO_x$. Furthermore, combustion flames that have flowed through the different flame flow passages R1, R2, R3, and R4 collide and mix together in the spaces VX3 and VZ3 of specific temperature zone, by which mixing the contact between unreacted CO and oxygen of reaction radicals and/or oxygen atoms is actively effected while the high-temperature residence time of combustion gas is prolonged by generation of eddy currents due to mixing, with the result of substantially reduced CO amount.

The above effects have been experimentally established, which fact is described below.

The apparatus used in the experiments is shown in FIG. 4, comprising a boiler body K of the construction as shown in FIGS. 1 to 3, a duct D and a wind box W for feeding premixed gas to a burner 40, an economizer (feed water preheater) F. connected to a combustion exhaust gas outlet C, a steam outlet tube J, a blower (not shown) connected to the duct D, an exhaust cylinder H, and wire gauzes M1, M2 provided to the duct D for better mixing, and the like, wherein fuel gas of propane is fed from a portion N of the duct D. While steam pressure is held at 4.5–5.0 kg/cm$^2$ G and excess air ratio is varied by controlling the number of rotations of the blower, concentrations of $NO_x$ and CO discharged at various oxygen concentrations were measured at the place of the economizer E downstream of the combustion exhaust gas outlet C.

Figure 6:
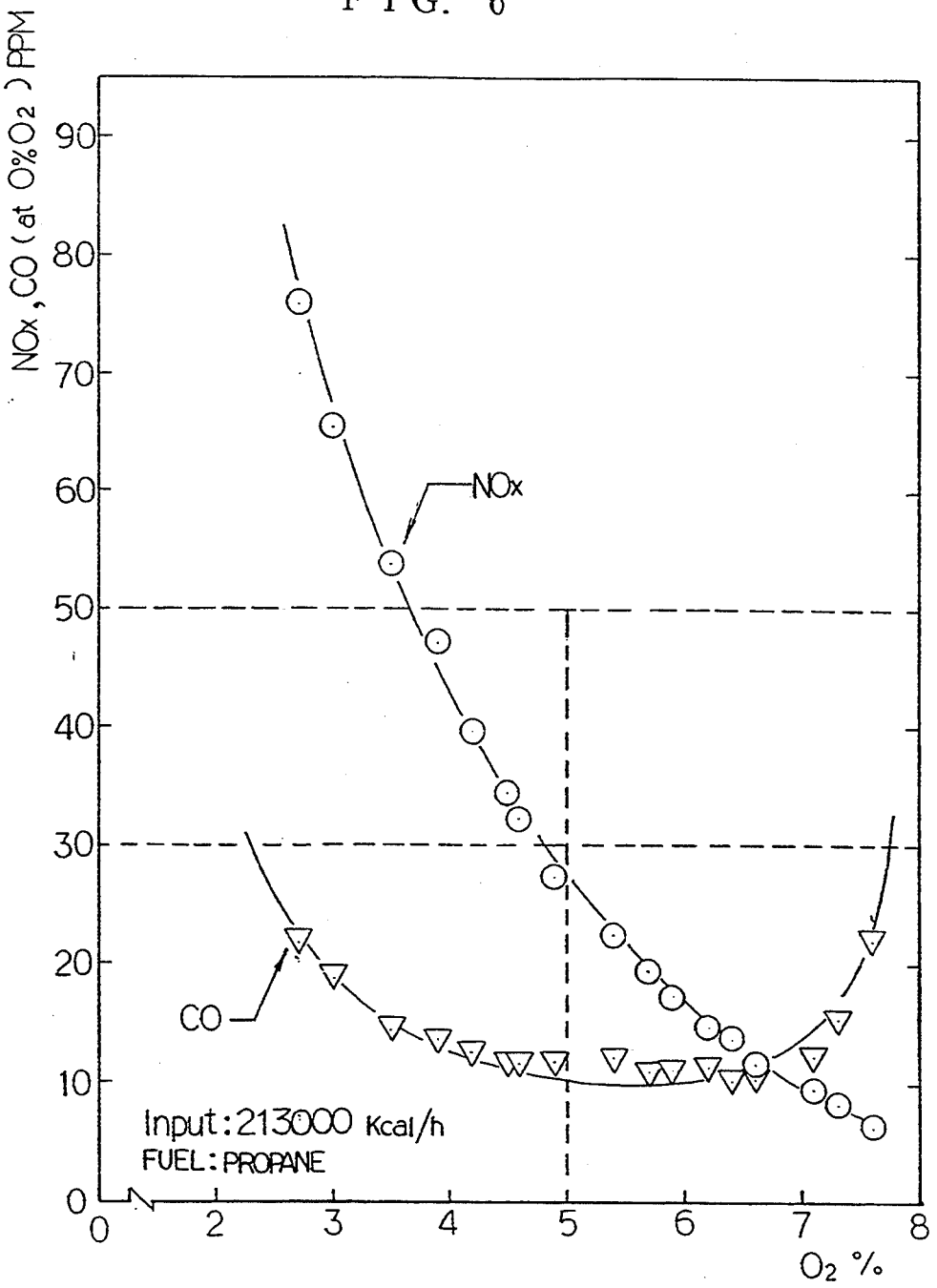
FIG. 6 is a chart of $NO_x$ and CO emission characteristics of the boiler body of the same embodiment.
Figure 7:
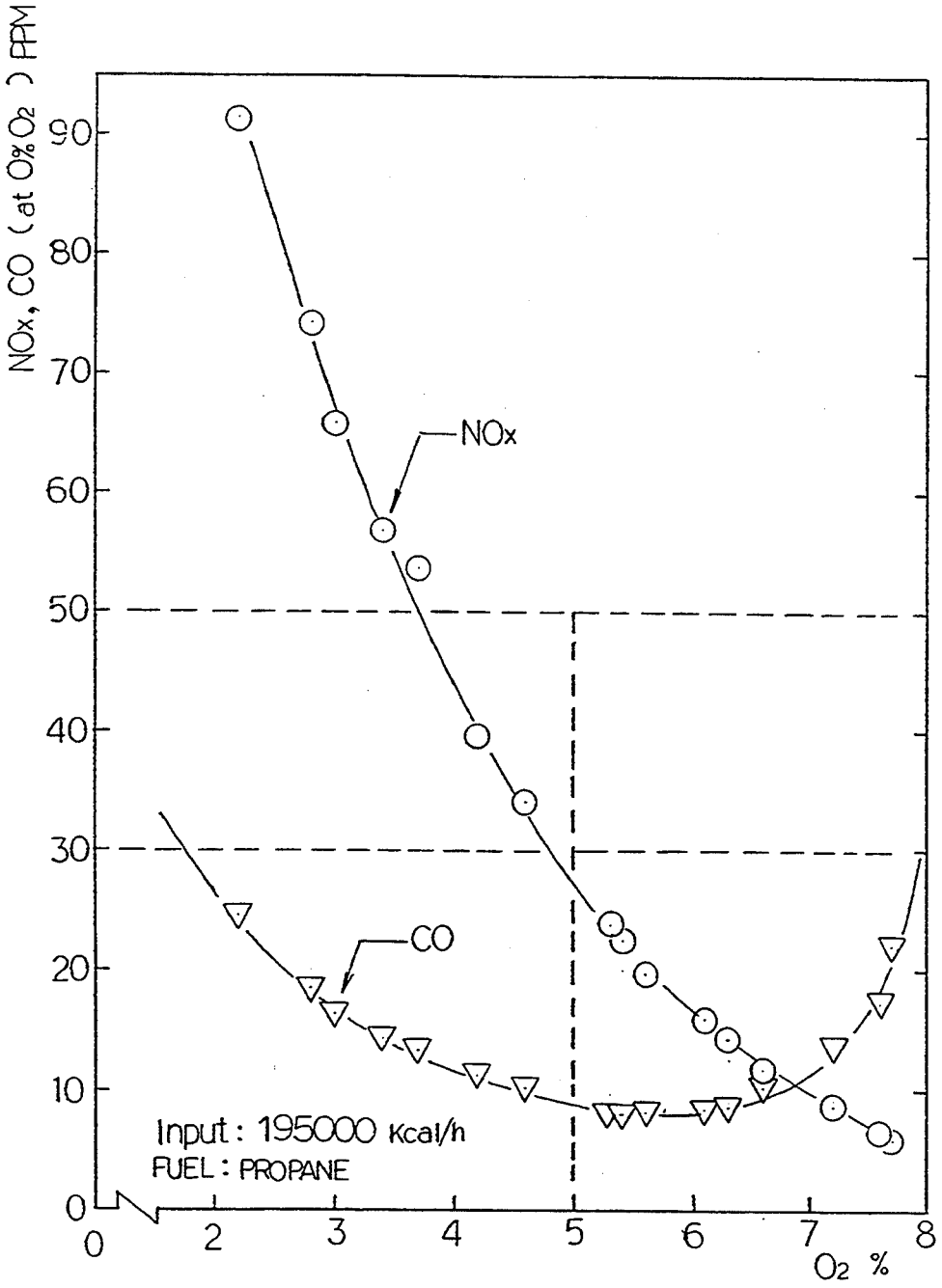
FIG. 7 is a chart of $NO_x$ and CO emission characteristics for different inputs of the boiler body of the same embodiment.
Figure 9:
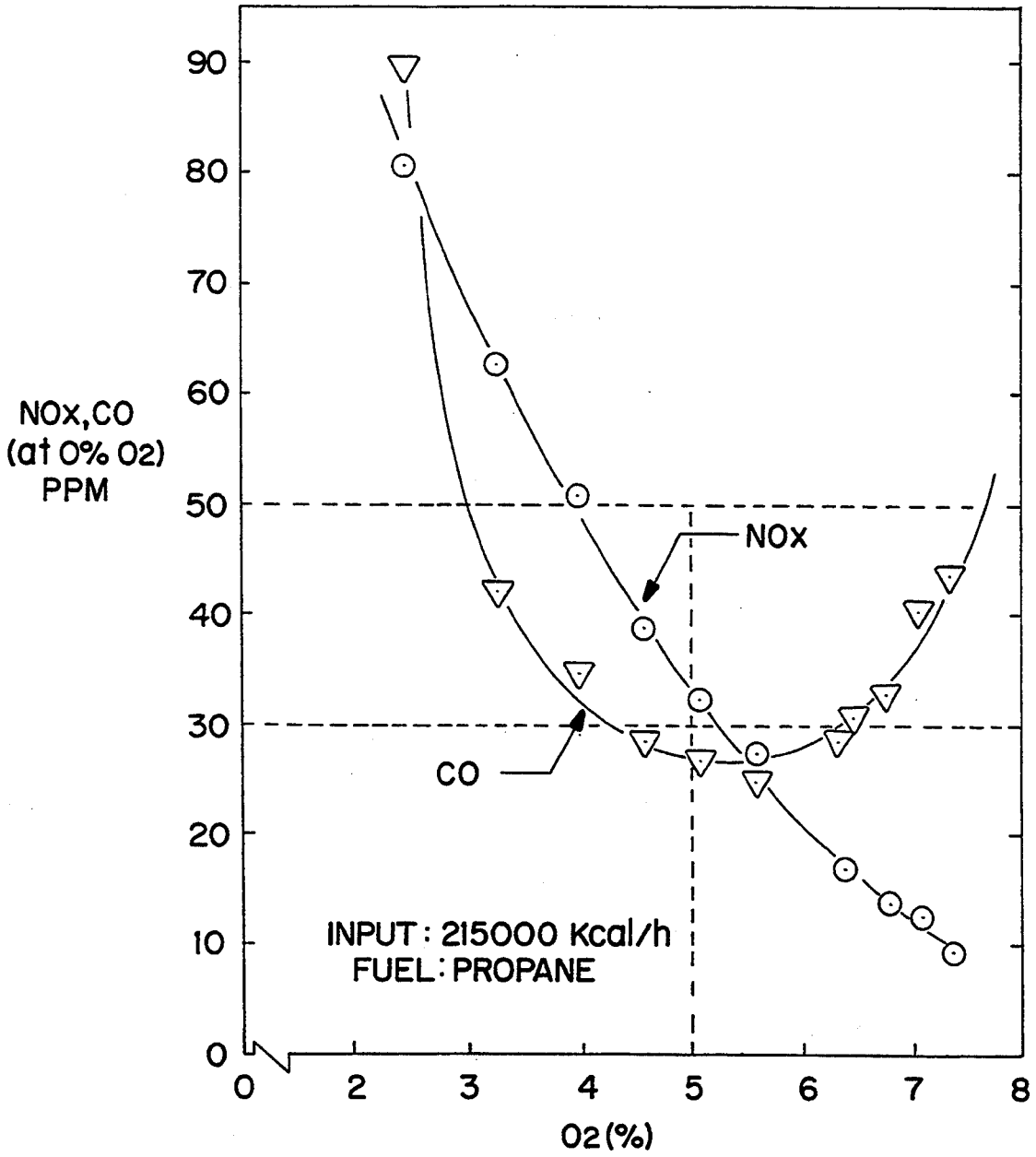
FIG. 9 PRIOR ART
FIG. 9 is a chart of $NO_x$ and CO emission characteristics of a prior-art boiler body.
Figure 10:
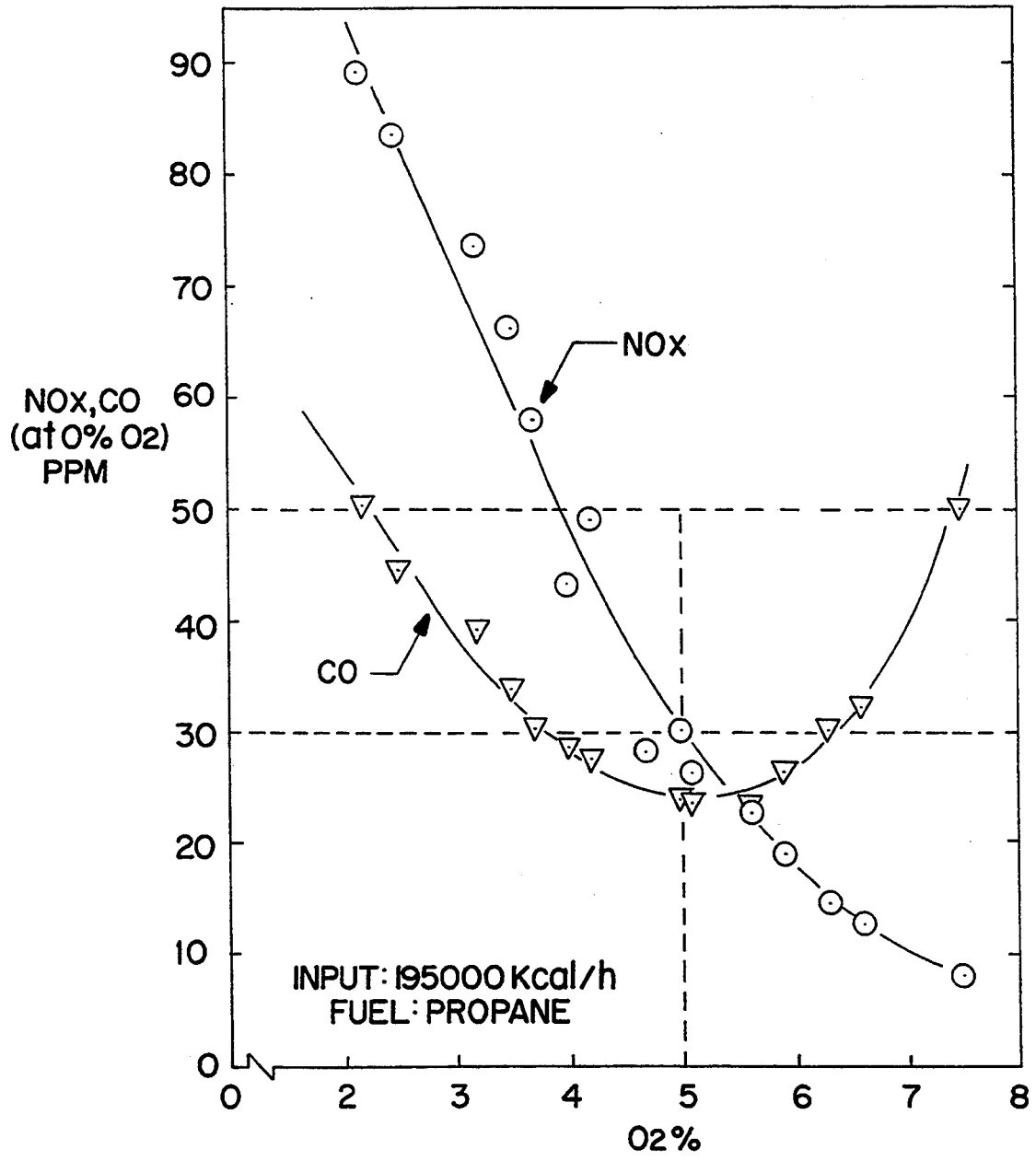
FIG. 10 PRIOR ART
FIG. 10 is a chart of $NO_x$ and CO emission characteristics for different inputs of the prior-art boiler body.

FIGS. 6 and 7 show measurement results of the present embodiment (a case where the spaces of specific temperature zone are formed). As understood from these results, there was almost no variation in $NO_x$, compared with measurement results by using the conventional boiler body K' that has no spaces of specific temperature zone as shown in FIGS. 9 to 10, and CO concentration, which was 24–27 ppm in the conventional apparatus, showed 9–10 ppm (both by 0% of $O_2$ conversion), to a 63% reduction effect. Also, this low range of CO level covers almost the entire measurement range with $O_2$ being 2.5–7.2%, for example if the lowest value in the conventional apparatus is taken as the threshold value. This means that even under more or less deteriorated combustion conditions, CO emission concentration is maintained low.

Figure 11:
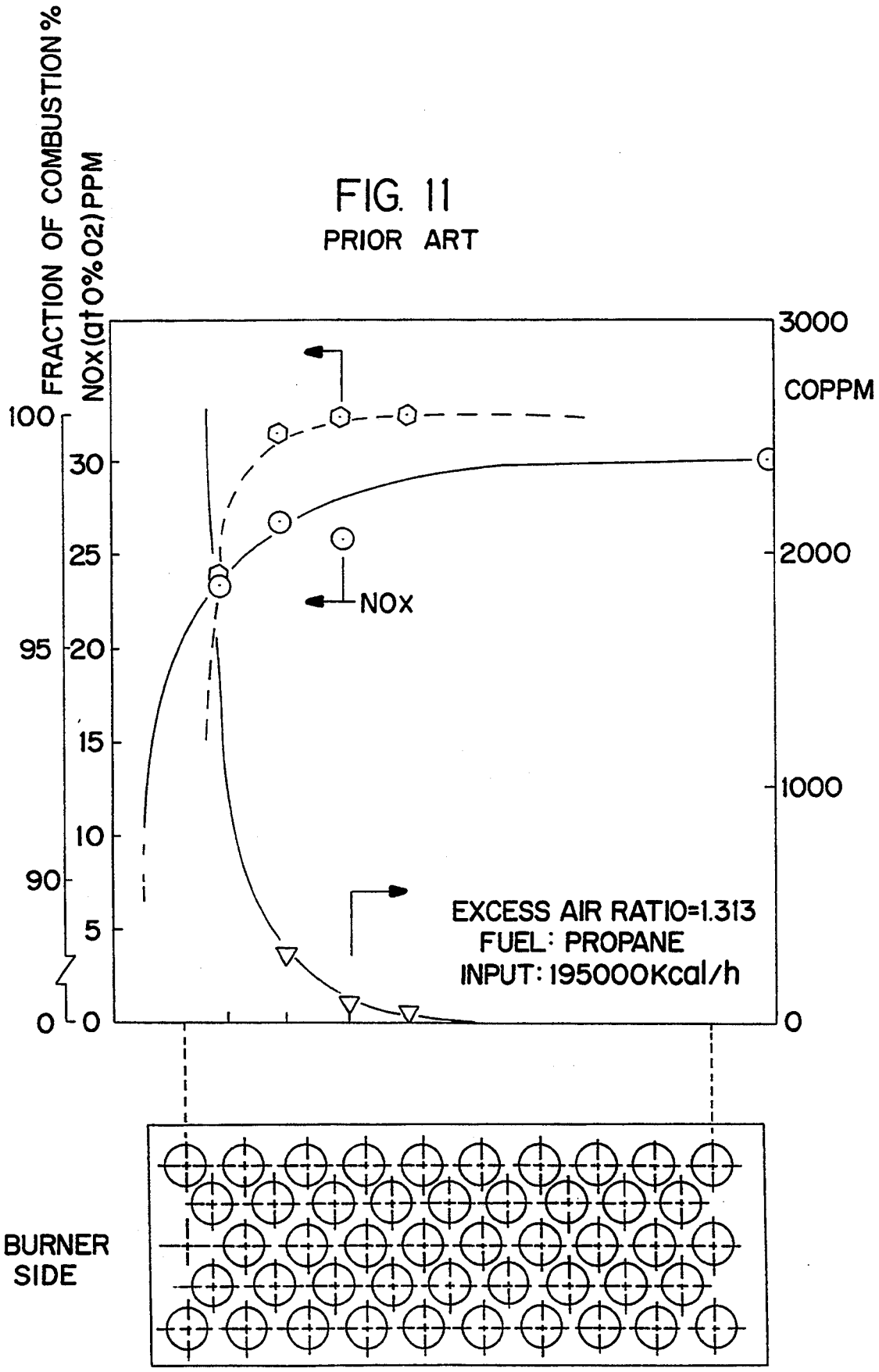
FIG. 11 PRIOR ART
FIG. 11 is a chart of $NO_x$ generation, CO reduction, and reaction rate characteristics within the prior-art boiler body.

FIG. 8 shows the $NO_x$ and CO reaction rate, where it can be seen that CO rapidly decreases in amount in the spaces of specific temperature zone. In addition, FIG. 11 gives a characteristic view of the conventional apparatus, corresponding to FIG. 8.

In the above embodiment, the arrangement that the temperature range of the specific temperature zone is set to approximately 1000° C.–1300° C. can be verified from the following. That is, the oxidation reaction velocity of CO at low temperatures (below 1500° C.) is represented by the following equation:

$$-d[CO]/dt = 1.2\times10^{11}[CO_2][O_2]^{0.3}[H_2O]^{0.5}\exp^{(-8050/T)}$$

Figure 13:
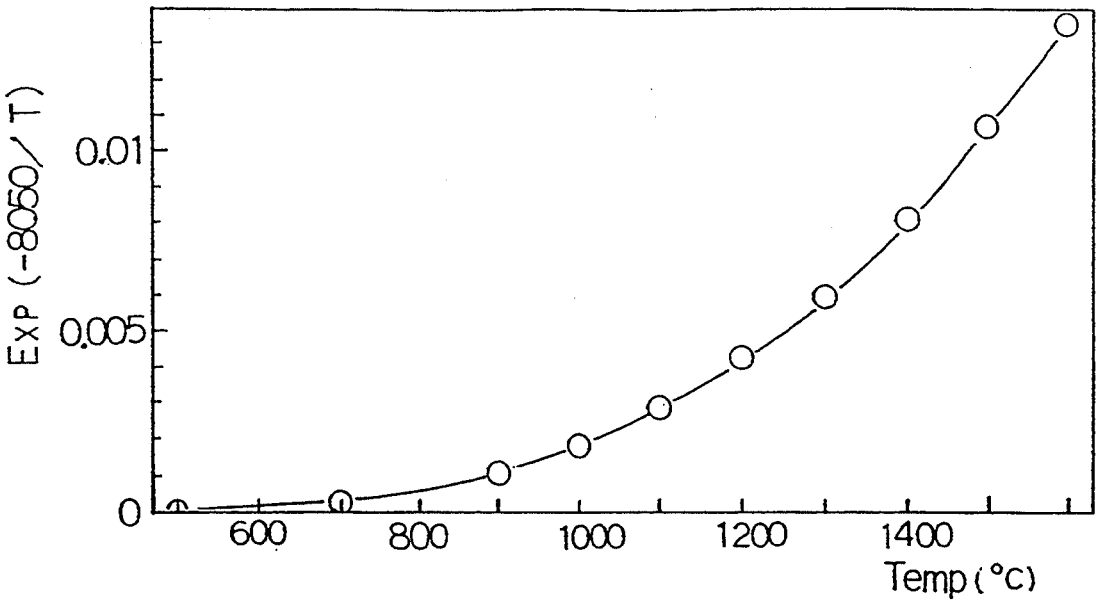
FIG. 13 is a characteristic chart showing the relationship between CO oxidation-decrease reaction rate and combustion gas temperature.
Figure 14:
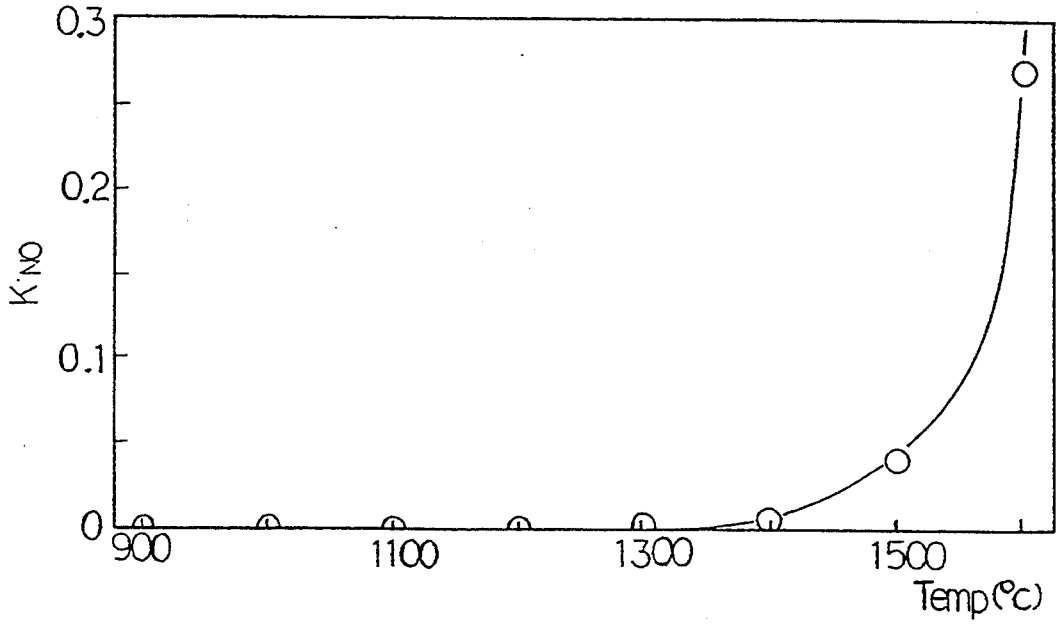
FIG. 14 is a characteristic chart showing the relationship between $NO_x$ reaction velocity coefficient and combustion gas temperature.

The oxidation reaction velocity of CO at each temperature range is as shown in FIG. 13, so that CO can be easily reduced structurally by forming spaces of specific temperature zone at high-temperature portions. However, according to FIG. 14 that shows the relationship between the $NO_x$ reaction velocity coefficient and combustion gas temperature, if the temperature of the space of specific temperature zone is higher than 1300° C., thermal $NO_x$ will be generated to such a larger extent as depends on the prolonged high-temperature residence time, which implies that this temperature band range should be avoided.

In addition, the present invention is not limited to the above-described embodiments. For example, in each of the embodiments, the tube walls 10, 10 have been provided by arranging a plurality of heat absorbing tubes 11, 11, . . . arrayed vertically at appropriate intervals and closing the gaps between the heat absorbing tubes 11, 11, . . . with plate-shaped finned members 12. However, the tube wall structure may alternatively be such that the gaps between the heat absorbing tubes 11 are formed by appropriate fireproof structure, or that the heat absorbing tubes 11 are arrayed in close contact state.

Figure 15:
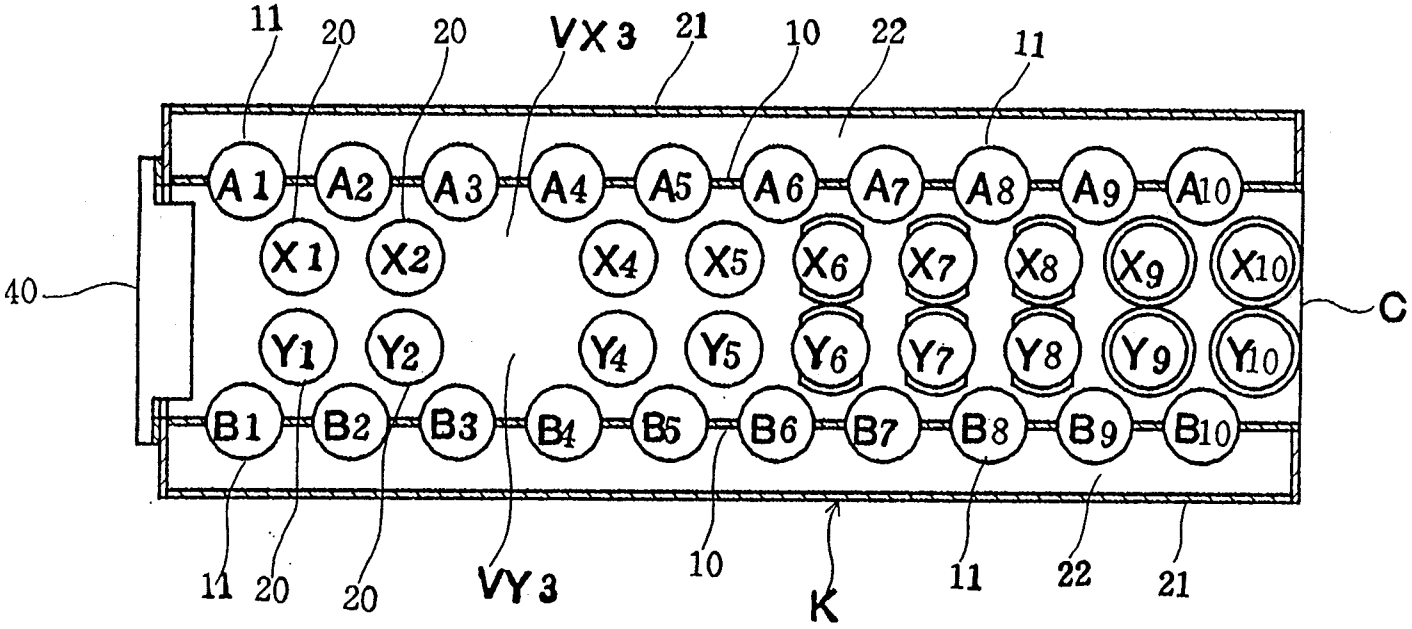
FIG. 15 is a plan view, partly in section, schematically showing the structure of a boiler body of another embodiment of the present invention.

Further, the number of columns of heat absorbing tubes arrayed between the tube walls is not limited to that used in the above embodiment. For example, the heat absorbing tubes 20 are arrayed in two columns X1, X2, . . . , Y1, Y2, . . . as shown in FIG. 15, where spaces VX3 and VY3 of specific temperature zone as the aforementioned specific temperature zone are formed. In this case, around the spaces VX3 and VY3 of specific temperature zone there are located heat absorbing tubes X2, A3, A4, X4, Y4, B4, B3, and Y2. Also, in this embodiment heat absorbing tubes 11 constituting the tube walls 10, 10 and the heat absorbing tubes 20 located between the tube walls 10, 10 are staggered, while the heat absorbing tubes 20, 20 are not staggered. However, the present invention can be applied to such a boiler body structure.

Figure 16:
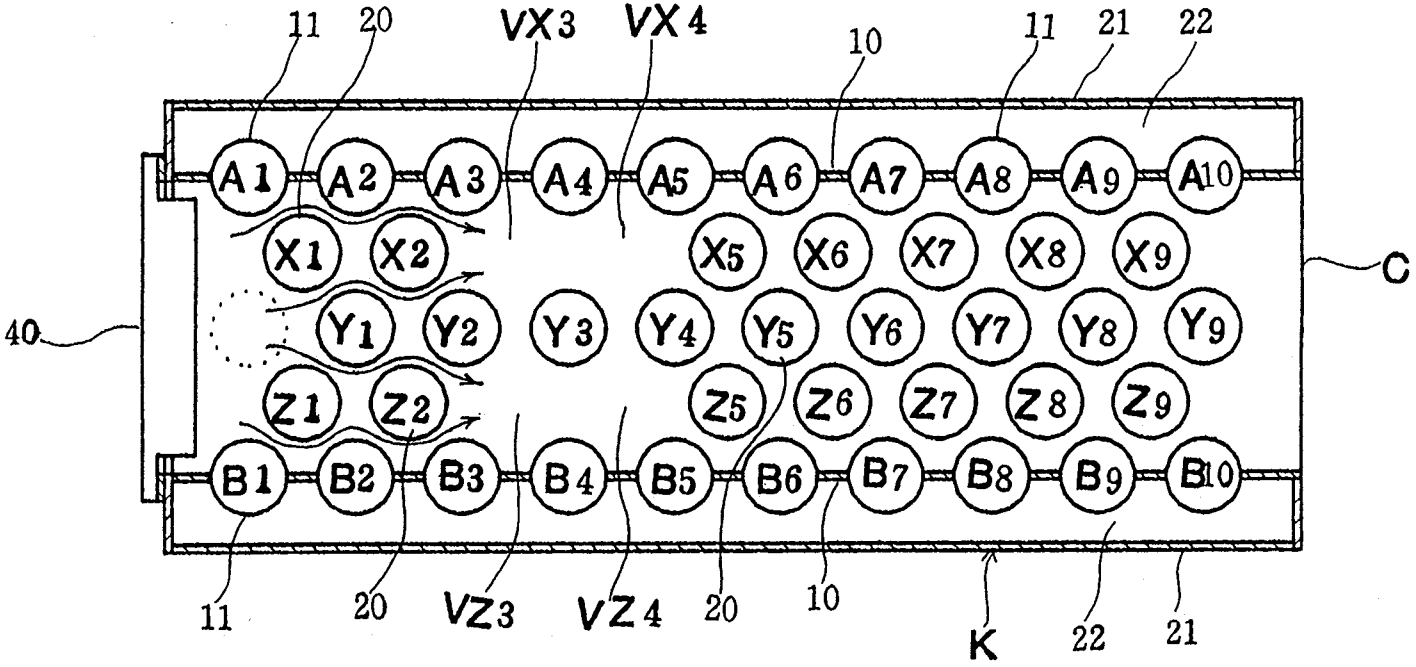
FIG. 16 is a plan view, partly in section,schematically showing the structure of a boiler body of still another embodiment of the present invention.
Figure 17:
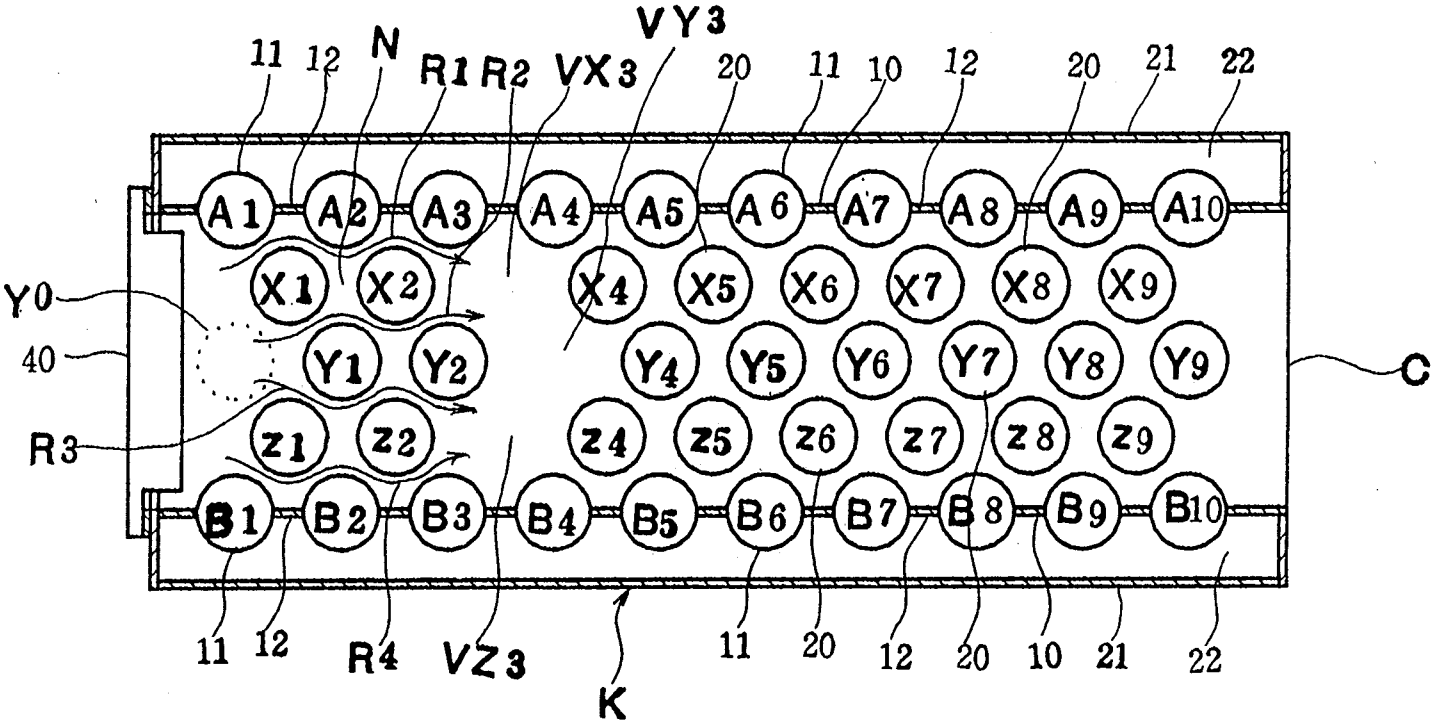
FIG. 17 is a plan view, partly in section, schematically showing the structure of a boiler body of yet another embodiment of the present invention.

Furthermore, the present invention can be applied to such an apparatus that the burner and heat absorbing tubes are disposed not vertically but horizontally. Yet further, as shown in FIG. 16, spaces VX3, VX4, VZ3, and VZ4 of specific temperature zone may be formed by setting the number of decimated heat absorbing tubes to two. Further, as shown in FIG. 17, spaces of VX3, VY3, and VZ3 of specific temperature zone may be formed by decimating the heat absorbing tube Y3 of FIG. 1. Further, although the heat absorbing tubes 11 and the heat absorbing tubes 20 have been disposed around the spaces of specific temperature zone in the above-described embodiment, it is also possible that if the number of columns of heat absorbing tubes 20 is large, only the heat absorbing tubes 20 surround the spaces of specific temperature zone. It is still possible that a heat absorbing tube is inserted into the portion indicated by Y0 in FIG. 1 to design further reduction in $No_x$.

Still further, the present invention, applicable to water tube boilers other than the once-through type, can be applied not only to water tube boilers in which steam is generated but also to water tube boilers in which hot water is generated. Further, although the heat medium distributing through the heat absorbing tubes 20 has been provided by water, it may also be some other medium such as oil other than water.

As described above, according to the present invention, since combustion flames in the spaces of specific temperature zone are enough to transform residual CO into $CO_2$ by oxidation reaction and the temperature is such one that causes less generation of thermal $NO_x$, it is possible that while generation of $NO_x$ is suppressed, residual CO is transformed into $CO_2$ by oxidation reaction with the result of reduced CO. Thus, there is provided a low-$NO_x$, low-CO combustion method and apparatus which involves less amounts of $NO_x$ and CO emission.

Also, according to the present invention, since the spaces of specific temperature zone are locally formed, temperature rise of boiler body walls can be suppressed small, compared with those in which unified, relatively wide adiabatic space is formed, thus eliminating the need of working with adiabatic materials for the inner surfaces of the boiler body walls to prevent any temperature rise. Thus there can be provided a combustion apparatus which is less in cost and superior in durability.

Further, according to the present invention, the spaces of specific temperature zone are locally formed at a narrow range so that there can be provided a boiler body which is space-saving and superior in thermal efficiency.

Although the present invention has been fully described by way of example with reference to the accompanying drawings, it is to be noted here that various changes and modifications will be apparent to those skilled in the art. Therefore, unless otherwise such changes and modifications depart from the scope of the present invention as defined by the appended claims, they should be construed as included therein.

What is claimed is:

1. A combustion apparatus comprising:

a pair of substantially parallel heat absorbing tube walls defining a section;

a burner disposed on a first side of said section;

a combustion exhaust gas outlet disposed on a second side of said section;

a plurality of heat absorbing tubes disposed in said section so that said heat absorbing tubes cross a combustion flame produced by said burner, said heat absorbing tubes being substantially parallel with one another and arranged at specific intervals, at least one heat absorbing tube at a predetermined one of said specific intervals being decimated to locally form a specific temperature zone in said section for suppressing generation of $NO_x$ and accelerating oxidation of CO.

2. A combustion apparatus as claimed in claim 1, wherein said heat absorbing walls include a plurality of heat absorbing tubes connected by fin members.

3. A combustion apparatus as claimed in claim 1, wherein said heat absorbing tubes form at least three rows of heat absorbing tubes, and at least one heat absorbing tube at said predetermined one of said specific intervals in two of said three rows is decimated to form two specific temperature zones.

4. A combustion apparatus as claimed in claim 3, wherein adjacent rows of said heat absorbing tubes are staggered from one another.

5. A combustion apparatus as claimed in claim 1, wherein said heat absorbing tubes form at least three rows of heat absorbing tubes, and at least one heat absorbing tube at said predetermined one of said specific intervals in each of said three rows is decimated to form three specific temperature zones.

6. A combustion apparatus as claimed in claim 5, wherein adjacent rows of said heat absorbing tubes are staggered from one another.

7. A combustion apparatus as claimed in claim 1, wherein said heat absorbing tubes form at least two rows of heat absorbing tubes, and at least one heat absorbing tube at said predetermined one of said specific intervals in each of said two rows is decimated to form two specific temperature zones.

8. A combustion apparatus as claimed in claim 7, wherein adjacent rows of said heat absorbing tubes are aligned with one another.

9. A combustion apparatus as claimed in claim 1, wherein said heat absorbing tubes are arranged so that a temperature range of said specific temperature zone is approximately 1000° C.–1300° C.

10. A combustion apparatus as claimed in claim 1, wherein said burner means is a premixed burner.

11. A combustion apparatus as claimed in claim 2, wherein said heat absorbing tubes adjacent to said specific temperature zone include heat absorbing tubes constituting one of said heat absorbing tube walls and said heat absorbing tubes disposed in said section.

12. A combustion apparatus as claimed in claim 1, wherein said heat absorbing tube walls comprise a plurality of heat absorbing tubes disposed substantially parallel to and spaced from one another along the direction of flow of said combustion flames, and finned members for connecting adjacent ones of said heat absorbing tubes constituting said heat absorbing tube walls.

13. A combustion apparatus as claimed in claim 12, wherein said heat absorbing tubes constituting the heat absorbing tube walls and said heat absorbing tubes disposed in said section are arranged in a specified pattern with gaps between adjacent heat absorbing tubes smaller than an outer diameter of the heat absorbing tubes.

14. A combustion apparatus as claimed in claim 1, wherein said heat absorbing tubes form a plurality of columns of meandered flame flow passages upstream of said specific temperature zone, and downstream-side ends of said flame flow passages communicate with said specific temperature zone.

15. A combustion apparatus as claimed in any of claims 1 or 9 to 14, wherein said heat absorbing tubes disposed in said section are water tubes of a water tube boiler.

16. A method of combustion comprising the steps of:

(a) providing a pair of substantially parallel heat absorbing tube walls defining a section;

(b) producing a combustion flame using a burner disposed on a first side of said section;

(c) providing a plurality of heat absorbing tubes disposed in said section so that said heat absorbing tubes cross said combustion flame produced by said burner, said heat absorbing tubes being substantially parallel with one another and arranged at specific intervals, at least one heat absorbing tube at a predetermined one of said specific intervals being decimated to locally form a specific temperature zone in said section for suppressing generation of $NO_x$ and accelerating oxidation of CO; and (d) exhausting combustion gas using a combustion exhaust gas outlet disposed on a second side of said section.

17. A method as claimed in claim 16, wherein said step (c) provides said heat absorbing tubes such that a temperature range of said specific temperature zone is approximately 1000° C.–1300° C.

* * * * *